US010207849B2

(12) United States Patent
Su

(10) Patent No.: US 10,207,849 B2
(45) Date of Patent: Feb. 19, 2019

(54) ANTI-THEFT HANGTAG FOR TOOL AND COMBINATION THEREOF WITH TOOL

(71) Applicant: Hong Ann Tool Industries Co., Ltd., Taichung (TW)

(72) Inventor: Cheng-Wei Su, Taichung (TW)

(73) Assignee: Hong Ann Tool Industries Co., Ltd., Taichung (TW)

( * ) Notice: Subject to any disclaimer, the term of this patent is extended or adjusted under 35 U.S.C. 154(b) by 0 days.

(21) Appl. No.: 15/480,434

(22) Filed: Apr. 6, 2017

(65) Prior Publication Data

US 2018/0072475 A1 Mar. 15, 2018

(30) Foreign Application Priority Data

Sep. 9, 2016 (TW) ..... 105129370 A

(51) Int. Cl.
*B65D 73/00* (2006.01)
*A47F 5/08* (2006.01)
*B25H 3/00* (2006.01)

(52) U.S. Cl.
CPC ..... *B65D 73/0064* (2013.01); *A47F 5/0861* (2013.01); *B25H 3/003* (2013.01); *B65D 2211/00* (2013.01)

(58) Field of Classification Search
CPC .. A47F 7/00; A47H 1/10; B65D 73/00; B65D 73/0064; B65D 85/20; B65D 2211/00; B65D 79/02
USPC ..... 206/349, 378, 806; 211/70.6
See application file for complete search history.

(56) References Cited

U.S. PATENT DOCUMENTS 6,637,591 B2 * 10/2003 Chen ..... B65D 73/0014 206/349
8,448,787 B1 * 5/2013 Chang ..... B65D 73/0064 206/378
8,857,777 B2 * 10/2014 Chang ..... B65D 73/0064 206/378
8,864,097 B2 * 10/2014 Wang ..... F16M 13/005 206/349
9,604,771 B1 * 3/2017 Chen ..... B25H 3/003
2005/0126943 A1 * 6/2005 Liu ..... B65D 73/0064 206/378

FOREIGN PATENT DOCUMENTS

TW 414142 U 12/2000

* cited by examiner

*Primary Examiner* — Bryon Gehman
(74) *Attorney, Agent, or Firm* — Alan D. Kamrath; Kamrath IP Lawfirm, P.A.

(57) ABSTRACT

An anti-theft hangtag includes a body adapted to attach to a tool. The body includes a plate, two engaging portions integrally connected with the plate, a flexible portion located between and connected with the two engaging portions, and a linkage portion connected with the plate and the flexible portion. The two engaging portions are respectively elastically deflectable relative to the plate. The two engaging portions have two faces parallel to each other. When the body is attached to the tool, the two engaging portions are inserted into the tool and are respectively elastically deflected to actuate the flexible portion to elastically abut against the two engaging portions. One of the two engaging portions is engaged with the tool so that the tool is unable to detach from the body to achieve an anti-theft function.

18 Claims, 5 Drawing Sheets

ANTI-THEFT HANGTAG FOR TOOL AND COMBINATION THEREOF WITH TOOL

BACKGROUND OF THE INVENTION

The present invention relates to an anti-theft hangtag and, particularly, to an anti-theft hangtag for a tool socket.

Taiwan Invention Patent No. 414142 discloses a socket joint post structure for a hand tool hanger. A joint post includes a penetrating through-slot at two opposite sides. The through-slot forms a connection portion at one side of the joint post. The connection portion has one or more hollowed-out portions to form at least one elastic arm extending from an inner periphery of the through-slot to the center and to form a protruded engaging point at the center for engaging with a recess in an inner periphery of a square hole of a socket.

However, the socket can easily be taken without authorization from the joint post, and such theft is a serious problem for the manager of the hardware store.

The present invention is, therefore, intended to obviate or at least alleviate the problems encountered in the prior art.

BRIEF SUMMARY OF THE INVENTION

An anti-theft hangtag includes a body adapted to attach to a tool. The body includes a plate, a first engaging portion integrally connected with the plate, a second engaging portion integrally connected with the plate, a flexible portion located between and connected with the first and second engaging portions, and a linkage portion connected with the plate and the flexible portion. The first and second engaging portions are respectively elastically deflectable relative to the plate. The first engaging portion includes a first face located at a side thereof opposite to the second engaging portion. The second engaging portion includes a second face located at a side thereof opposite to the first engaging portion. The first face is parallel to the second face.

When the body is attached to the tool, the first and second engaging portions are inserted into the tool and are respectively elastically deflected to actuate the flexible portion to elastically abut against the first and second engaging portions. One of the first and second engaging portions is engaged with the tool so that the tool is unable to detach from the body to achieve an anti-theft function.

The present invention will become clearer in light of the following detailed description of illustrative embodiments of this invention described in connection with the drawings.

DETAILED DESCRIPTION OF THE INVENTION

Figure 1:
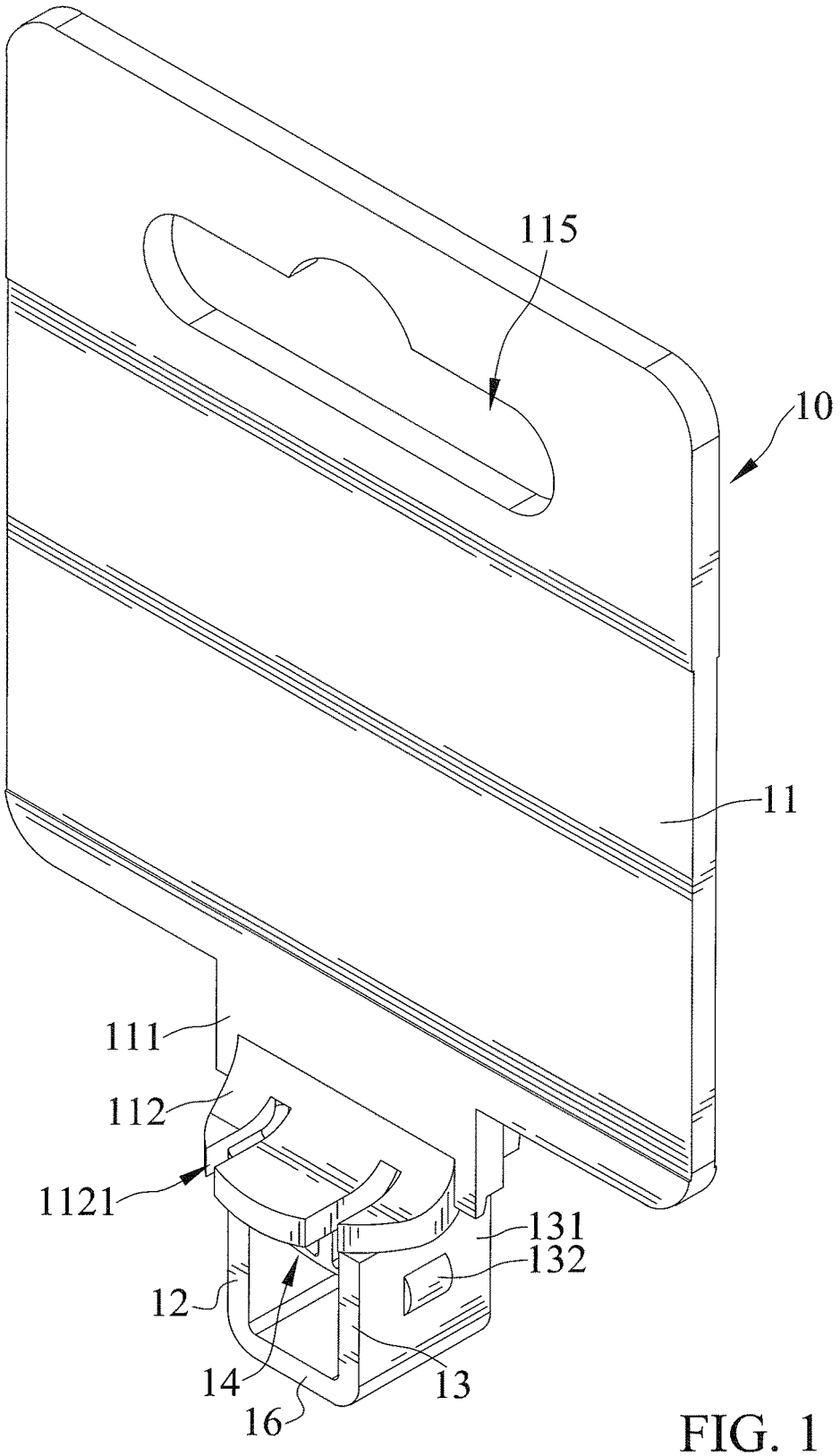
FIG. 1 is a perspective view of an anti-theft hangtag according to the present invention.
Figure 2:
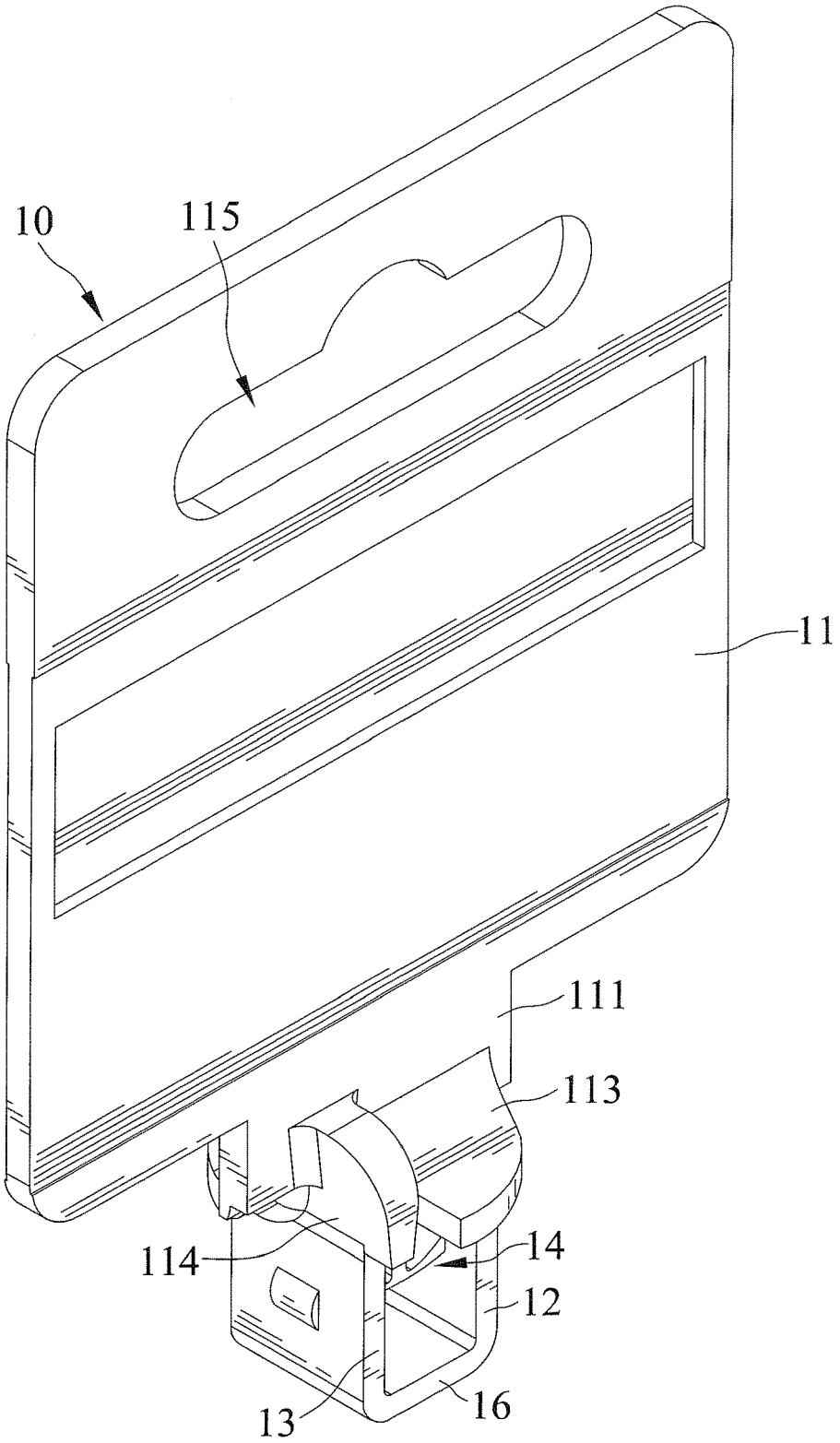
FIG. 2 is another perspective view of the anti-theft hangtag according to the present invention.
Figure 3:
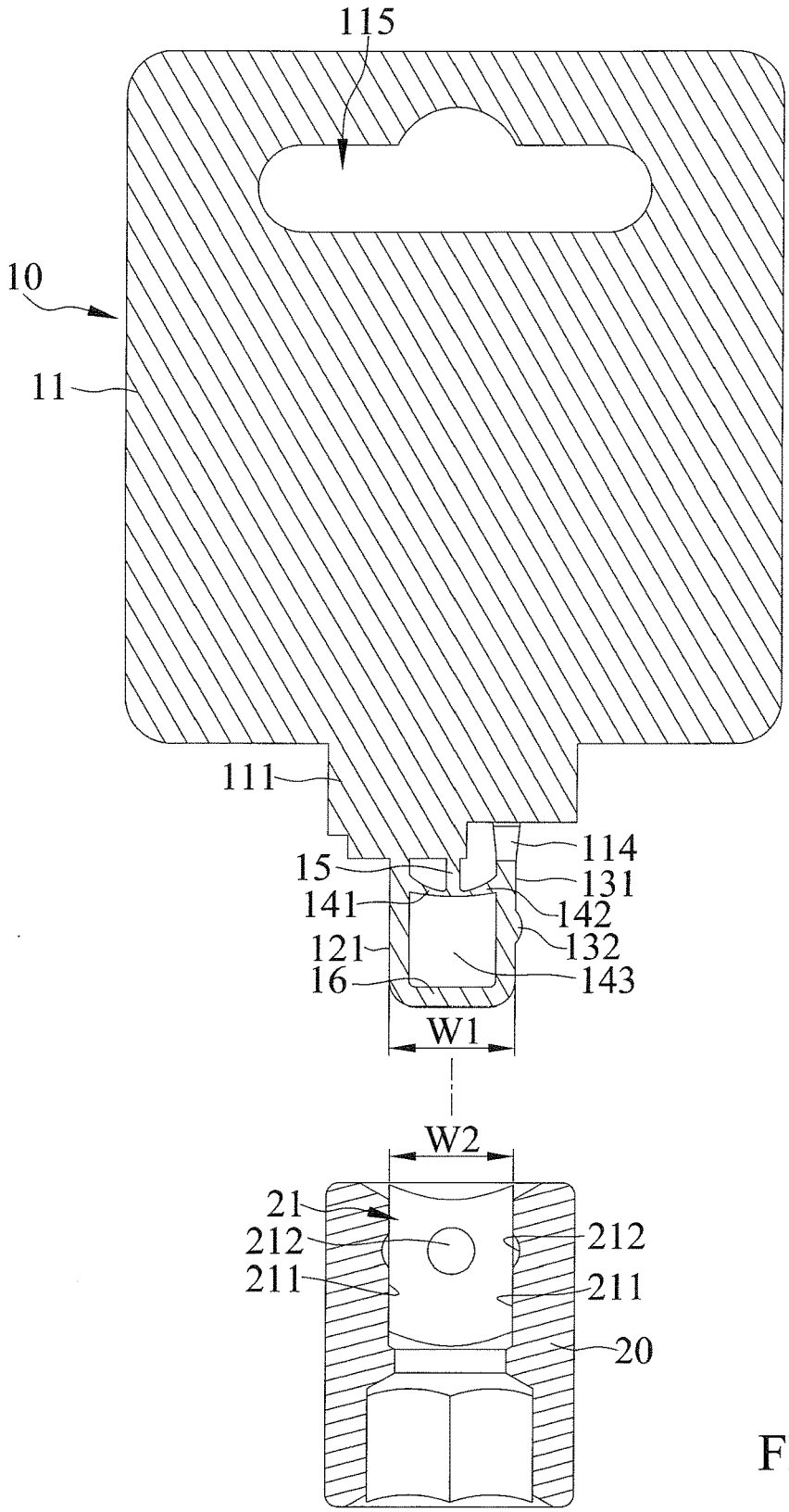
FIG. 3 is a cross-sectional view of the anti-theft hangtag of FIG. 1.
Figure 4:
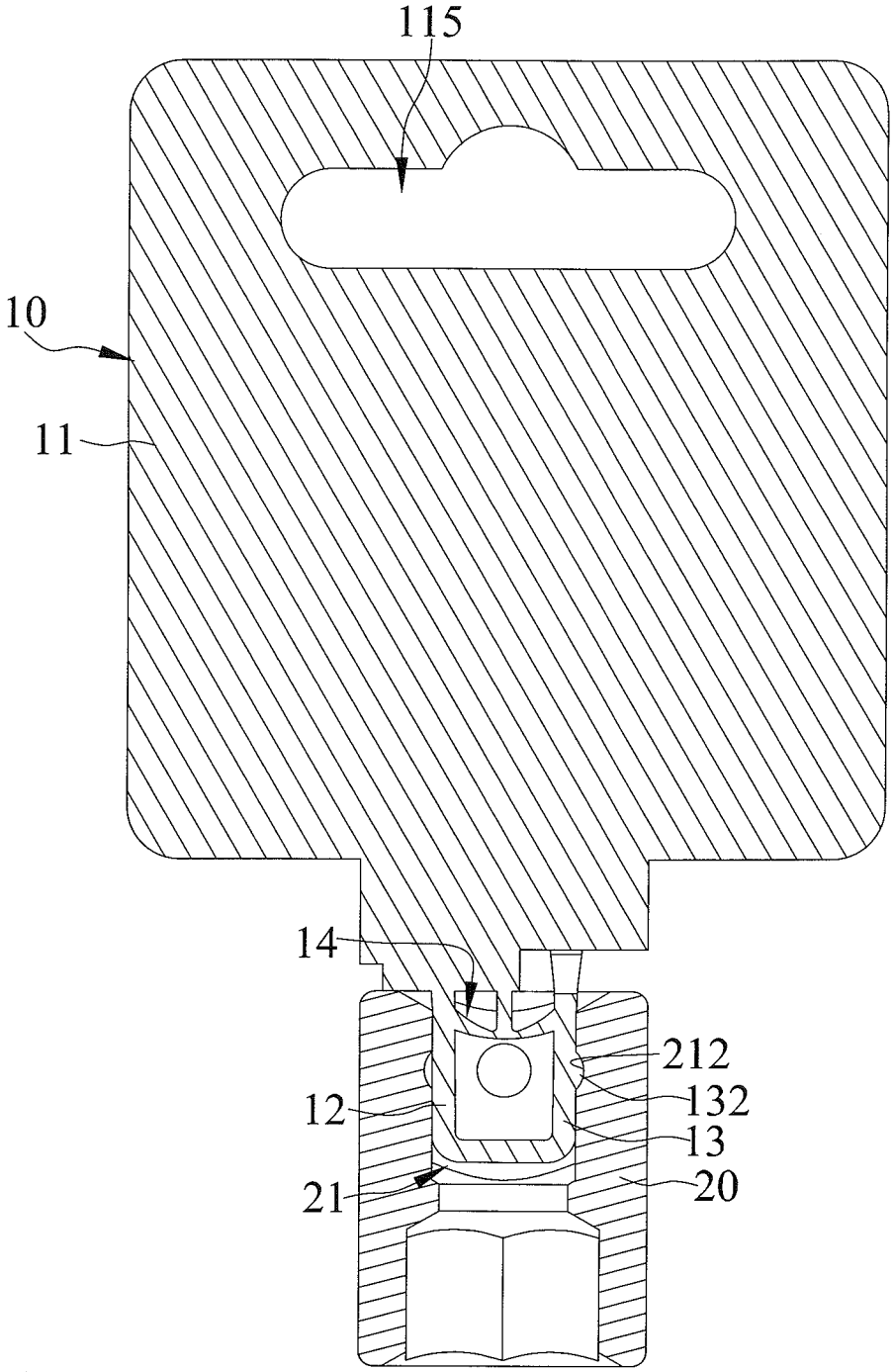
FIG. 4 is a continued view of FIG. 3 and illustrates a tool attached to the anti-theft hangtag.
Figure 5:
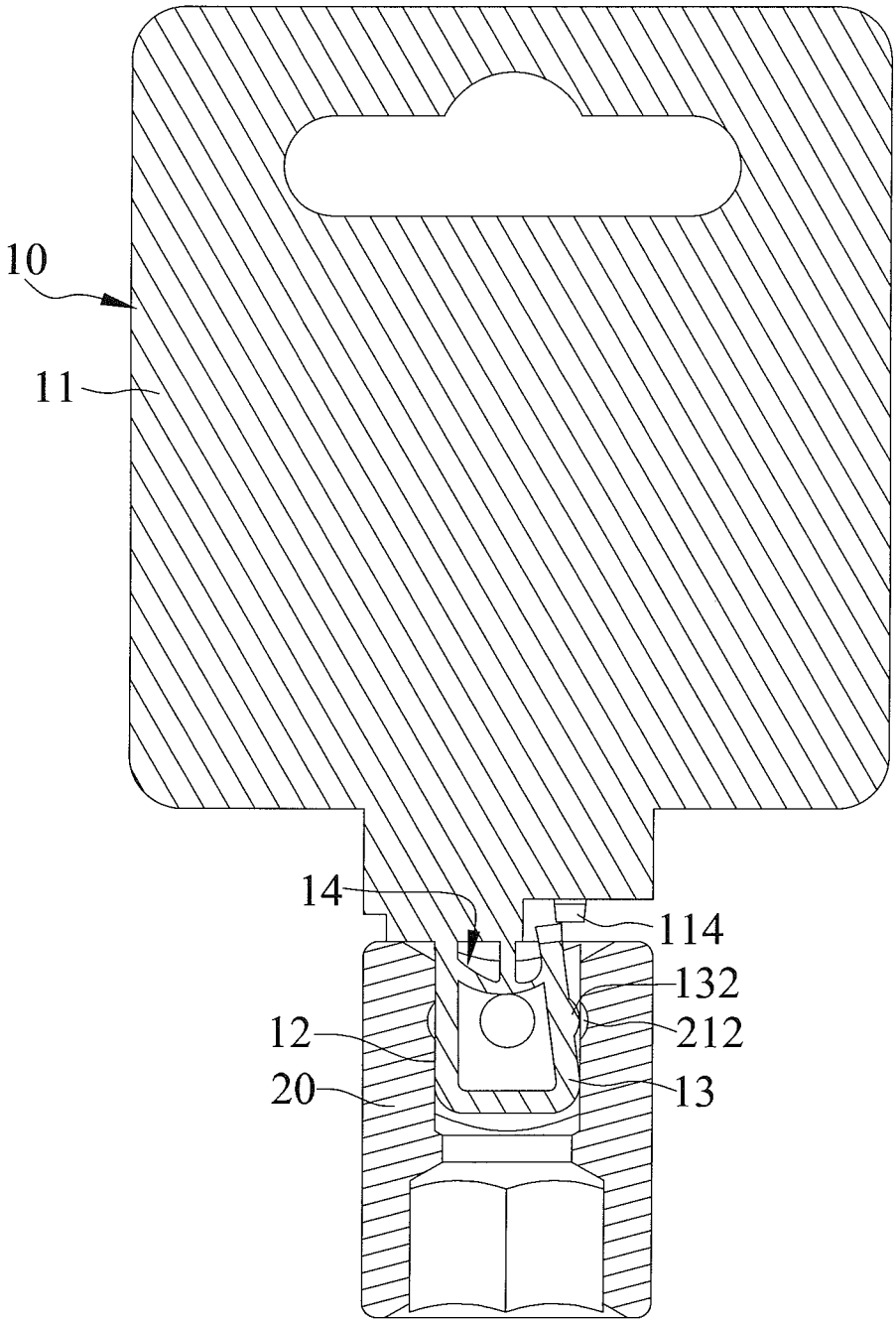
FIG. 5 is a continued view of FIG. 4 and illustrates that a connection section had been cut so that the tool is able to detach from the anti-theft hangtag.

FIGS. 1-5 show an anti-theft hangtag according to the present invention. The anti-theft hangtag includes a body 10 adapted to be hung on a display rack and adapted to attach to a tool 20 such as a socket. Tool 20 cannot be taken from body 10 simply by pulling tool 20 downwardly to achieve an anti-theft function.

Body 10 includes a plate 11, a first engaging portion 12 integrally connected with plate 11, a second engaging portion 13 integrally connected with plate 11, a flexible portion 14 located between and connected with first and second engaging portions 12 and 13, a linkage portion 15 connected with plate 11 and flexible portion 14, and an extended portion 16 connected with first and second engaging portions 12 and 13. First and second engaging portions 12 and 13 are respectively elastically deflectable relative to plate 11. Flexible portion 14 is located between plate 11 and extended portion 16 and is elastically flexible.

Plate 11 includes an extended section 111, a first plate section 112, a second plate section 113 connected with first plate section 112, a connection section 114 connected with a side of extended section 111 adjacent to second plate section 113, and a through-hole 115 penetrating therethrough. First and second plate sections 112 and 113 are connected with extended section 111 and are respectively located at two opposite sides of extended section 111. First and second plate sections 112 and 113 are integrally connected with first engaging portion 12 and linkage portion 15. Connection section 114 is integrally connected with second engaging portion 13. A first gap is formed between extended section 111 and connection section 114. A second gap is formed between second plate section 113 and connection section 114. Through-hole 115 is located at an end of plate 11 opposite to extended section 111, so that body 10 can be hung on the display rack via through-hole 115. First plate section 112 includes at least one slot 1121 located at a side thereof opposite to extended section 111. In the embodiment, first plate section 112 includes two slots 1121 to reduce the manufacturing cost.

First engaging portion 12 includes a first face 121 located at a side thereof opposite to second engaging portion 13. Second engaging portion 13 includes a second face 131 located a side thereof opposite to first engaging portion 12, and a protrusion 132 protruded from second face 131 and adapted to engage with tool 20. First face 121 is parallel to second face 131. A first width W1 is formed between first and second faces 121 and 131.

Flexible portion 14 includes a first flexible section 141, a second flexible section 142, and a linkage section 143 connected with linkage portion 15 and first and second flexible sections 141 and 142. An end of first flexible section 141 opposite to linkage section 143 is connected with first engaging portion 12. An end of second flexible section 142 opposite to linkage section 143 is connected with second engaging portion 13. Linkage section 143 is located between first and second flexible sections 141 and 142. First flexible section 141 is gradually tapered from first engaging portion 12 to linkage section 143. Second flexible section 142 is gradually tapered from second engaging portion 13 to linkage section 143. Thus, flexible portion 14 has an inverted T-shaped cross-section (shown in FIG. 3). Moreover, first and second flexible sections 141 and 142 and linkage section 143 of flexible portion 14 are located above protrusion 132 in a height direction to promote second engaging portion 13 elastically deflectable relative to plate 11.

Tool 20 includes an engaging hole 21 disposed at an end thereof. First engaging portion 12, second engaging portion 13, flexible portion 14, linkage portion 15, and extended portion 16 can be inserted into engaging hole 21. Engaging hole 21 has at least two inner walls 211 respectively located at two opposite sides thereof, and at least one recess 212 formed in one of at least two inner walls 211. A second width W2 is formed between at least two inner walls 211. First width W1 is larger than second width W2. First and second engaging portions 12 and 13 are respectively abuttable against at least two inner walls 211. In the embodiment, engaging hole 21 has four inner walls 211 to form a square hole, and four recesses 212 respectively formed in four inner walls 211. Protrusion 132 is engageable into one of recesses 212.

When body 10 is attached to tool 20, first and second engaging portions 12 and 13 are inserted into engaging hole 21 to be respectively elastically deflected, to tightly fit each other due to first width W1 being larger than second width W2. First and second flexible sections 141 and 142 are respectively elastically deflected to respectively abut against first and second engaging portions 12 and 13. First and second flexible sections 141 and 142 respectively abut against two opposite inner walls 211. Protrusion 132 is engaged into one of recesses 212 to cause tool 20 unable to detach from body 10 to achieve an anti-theft function.

Tool 20 therefore cannot be taken from body 10 simply by pulling tool 20 downwardly unless connection section 114 is cut by a cutting tool such as a pair of scissors.

When connection section 114 had been cut, and a user intends to detach tool 20 from body 10, the user can push an end of connection section 114 adjacent to second engaging portion 13 to cause second engaging portion 13 to be elastically deflected towards first engaging portion 12, so that second flexible section 142 is flexed, and protrusion 132 is disengaged from recess 212. Thus, tool 20 can be taken from body 10 simply by pulling tool 20 downwardly to remove the anti-theft function.

Although specific embodiments have been illustrated and described, numerous modifications and variations are still possible without departing from the scope of the invention. The scope of the invention is limited by the accompanying claims.

The invention claimed is:

1. An anti-theft hangtag comprising:

a body adapted to attach to a tool, with the body including a plate, a first engaging portion integrally connected with the plate, a second engaging portion integrally connected with the plate, a flexible portion located between and connected with the first and second engaging portions, and a linkage portion connected between and to both the plate and the flexible portion, with the first and second engaging portions respectively elastically deflectable relative to the plate, with the first engaging portion including a first face located at a side thereof opposite to the second engaging portion, with the second engaging portion including a second face located at a side thereof opposite to the first engaging portion, and with the first face parallel to the second face;

wherein when the body is attached to the tool, the first and second engaging portions are inserted into the tool and are respectively elastically deflected to actuate the flexible portion to elastically abut against the first and second engaging portions, wherein one of the first and second engaging portions is engaged with the tool so that the tool is unable to detach from the body, with the flexible portion including a first flexible section, a second flexible section, and a linkage section connected with the linkage portion and the first and second flexible sections, with an end of the first flexible section opposite to the linkage section connected with the first engaging portion, and with an end of the second flexible section opposite to the linkage section connected with the second engaging portion.

2. The anti-theft hangtag as claimed in claim 1, with the first flexible section gradually tapered from the first engaging portion to the linkage section, and with the second flexible section gradually tapered from the second engaging portion to the linkage section.

3. The anti-theft hangtag as claimed in claim 2, wherein the one of the first and second engaging portions is the second engaging portion; and wherein the second engaging portion is elastically deflectable towards the first engaging portion to flex the second flexible section and to detach the second engaging portion from the tool.

4. The anti-theft hangtag as claimed in claim 2, with the body further including an extended portion connected with the first and second engaging portions, with the flexible portion located between the plate and the extended portion, and with the second engaging portion including a protrusion protruded from the second face and adapted to engage with the tool.

5. The anti-theft hangtag as claimed in claim 4, with the first and second flexible sections and the linkage section of the flexible portion located above the protrusion.

6. The anti-theft hangtag as claimed in claim 1, with the linkage portion located intermediate the first and second engaging portions and extending between and connected with the plate and the flexible portion.

7. An anti-theft hangtag comprising:

a body adapted to attach to a tool, with the body including a plate, a first engaging portion integrally connected with the plate, a second engaging portion integrally connected with the plate, a flexible portion located between and connected with the first and second engaging portions, and a linkage portion connected between and to both the plate and the flexible portion, with the first and second engaging portions respectively elastically deflectable relative to the plate, with the first engaging portion including a first face located at a side thereof opposite to the second engaging portion, with the second engaging portion including a second face located at a side thereof opposite to the first engaging portion, and with the first face parallel to the second face;

wherein when the body is attached to the tool, the first and second engaging portions are inserted into the tool and are respectively elastically deflected to actuate the flexible portion to elastically abut against the first and second engaging portions, wherein one of the first and second engaging portions is engaged with the tool so that the tool is unable to detach from the body, with the plate including an extended section, a first plate section, a second plate section connected with the first plate section, and a connection section connected with a side of the extended section adjacent to the second plate section, with the first and second plate sections connected with the extended section and respectively located at two opposite sides of the extended section, with the first and second plate sections integrally connected with the first engaging portion, with the connection section integrally connected with the second engaging portion, with a first gap formed between the extended section and the connection section, and with a second gap formed between the second plate section and the connection section.

8. The anti-theft hangtag as claimed in claim 7, with the first plate section including at least one slot located at a side thereof opposite to the extended section.

9. The anti-theft hangtag as claimed in claim 7, with the flexible portion including a first flexible section, a second flexible section, and a linkage section connected with the linkage portion and the first and second flexible sections, with an end of the first flexible section opposite to the linkage section connected with the first engaging portion, and with an end of the second flexible section opposite to the linkage section connected with the second engaging portion.

10. The anti-theft hangtag as claimed in claim 7, with the first flexible section gradually tapered from the first engaging portion to the linkage section, and with the second flexible section gradually tapered from the second engaging portion to the linkage section.

11. The anti-theft hangtag as claimed in claim 10, wherein the one of the first and second engaging portions is the second engaging portion; and wherein the second engaging portion is elastically deflectable towards the first engaging portion to flex the second flexible section and to detach the second engaging portion from the tool.

12. The anti-theft hangtag as claimed in claim 7, with the linkage portion located intermediate the first and second engaging portions and extending between and connected with the plate and the flexible portion.

13. A combination comprising:

a body including a plate, a first engaging portion integrally connected with the plate, a second engaging portion integrally connected with the plate, a flexible portion located between and connected between and to both the first and second engaging portions, and a linkage portion connected with the plate and the flexible portion, with the first and second engaging portions respectively elastically deflectable relative to the plate, with the first engaging portion including a first face located at a side thereof opposite to the second engaging portion, with the second engaging portion including a second face located at a side thereof opposite to the first engaging portion, and a protrusion protruded from the second face, with the first face parallel to the second face, and with a first width formed between the first and second faces; and a tool including an engaging hole, with the engaging hole having at least two inner walls respectively located at two opposite sides thereof, and at least one recess formed in one of the at least two inner walls, with a second width formed between the at least two inner walls, and with the first width larger than the second width;

wherein the body is attached to the tool, the first and second engaging portions are inserted into the engaging hole of the tool and are respectively elastically deflected to actuate the flexible portion to elastically abut against the first and second engaging portions, wherein the first and second engaging portions respectively abut against the at least two inner walls, wherein the protrusion is engaged with the at least one recess so that the tool is unable to detach from the body, with the flexible portion including a first flexible section, a second flexible section, and a linkage section connected with the linkage portion and the first and second flexible sections, with an end of the first flexible section opposite to the linkage section connected with the first engaging portion, and with an end of the second flexible section opposite to the linkage section connected with the second engaging portion.

14. The combination as claimed in claim 13, with the first flexible section gradually tapered from the first engaging portion to the linkage section, and with the second flexible section gradually tapered from the second engaging portion to the linkage section.

15. The combination as claimed in claim 14, with the first and second flexible sections and the linkage section of the flexible portion located above the protrusion.

16. The combination as claimed in claim 14, wherein the one of the first and second engaging portions is the second engaging portion; and wherein the second engaging portion is elastically deflectable towards the first engaging portion to flex the second flexible section and to detach the second engaging portion from the tool.

17. The combination as claimed in claim 13, with the plate including an extended section, a first plate section, a second plate section connected with the first plate section, and a connection section connected with a side of the extended section adjacent to the second plate section, with the first and second plate sections connected with the extended section and respectively located at two opposite sides of the extended section, with the first and second plate sections integrally connected with the first engaging portion, with the connection section integrally connected with the second engaging portion, with a first gap formed between the extended section and the connection section, and with a second gap formed between the second plate section and the connection section.

18. The combination as claimed in claim 13, with the linkage portion located intermediate the first and second engaging portions and extending between and connected with the plate and the flexible portion.

* * * * *